United States Patent [19]

Albang et al.

[11] Patent Number: 4,610,566

[45] Date of Patent: Sep. 9, 1986

[54] CURB INLET WITH REMOVABLE GUTTER FORM

[75] Inventors: Nicholas P. Albang, Rohnert Park; Gary L. Lindsay, Petaluma; Daniel F. Foster, Corte Madera, both of Calif.

[73] Assignee: Phoenix Simpton Company, San Francisco, Calif.

[21] Appl. No.: 721,188

[22] Filed: Apr. 9, 1985

[51] Int. Cl.[4] ..... E01C 11/22

[52] U.S. Cl. ..... 404/4; 404/2; 249/1; 249/2; 249/10; 249/11; 52/127.3

[58] Field of Search ..... 404/2, 4, 5; 249/8, 249/2, 10, 1, 11, 189; 52/20, 102, 169.5, 127.3; 264/31, 35

[56] References Cited

U.S. PATENT DOCUMENTS

| | | | |
|---|---|---|---|
| 2,610,381 | 9/1952 | Rosati et al. | 249/2 |
| 3,844,073 | 10/1974 | Peletz | 404/2 X |
| 4,192,625 | 3/1980 | Peletz | 404/5 |

*Primary Examiner*—James A. Leppink
*Assistant Examiner*—Matthew Smith
*Attorney, Agent, or Firm*—Owen, Wickersham & Erickson

[57] ABSTRACT

A curb inlet having a removable non-concrete gutter form, which is an arcuate, generally rectangular strip having a concave front face and a convex rear face with a plurality of handles secured to the rear face and, also secured to that rear face, a plurality of aligning horizontal sleeves each having a tube portion and a latch portion and each having a locking bolt slidably mounted in the sleeves. The form can be locked in place in a pre-cast curb inlet member by the bolts entering openings in that pre-cast member. The form retains concrete when the concrete is poured against the pre-cast member. After the concrete sets, the bolts are withdrawn from the openings and the form can be removed through an access opening therein. The form strip may be a fiberglass-plastic resin structure.

11 Claims, 10 Drawing Figures

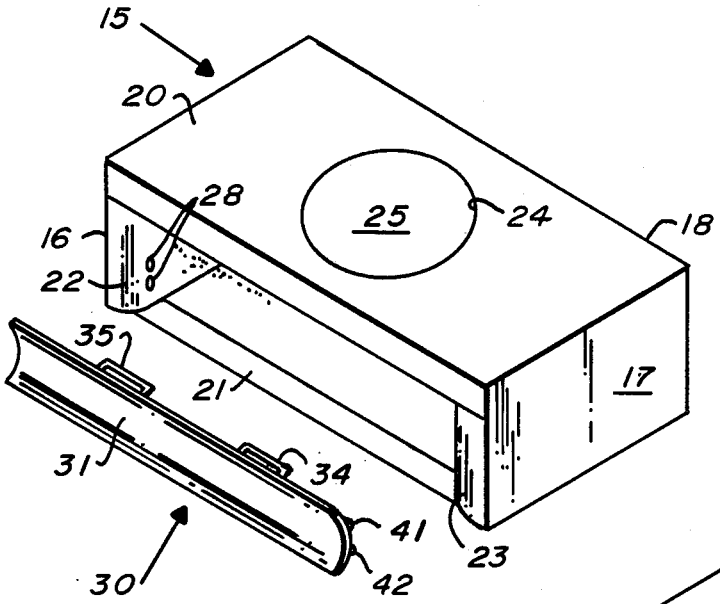
FIG. 1
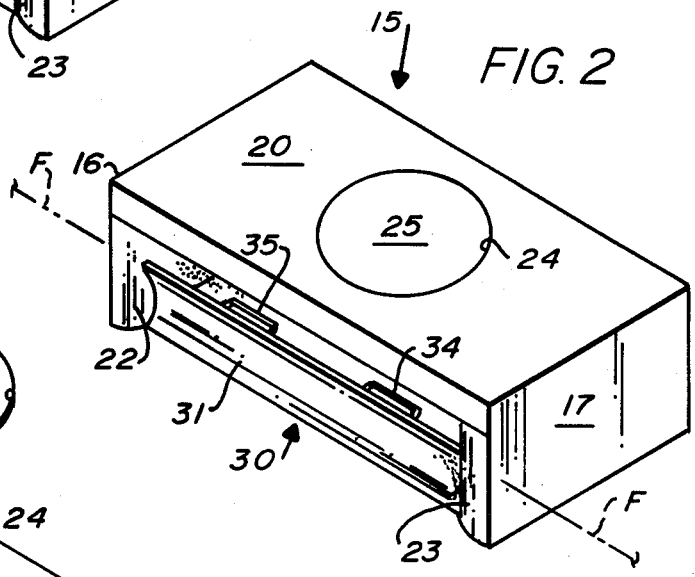
FIG. 2
FIG. 4
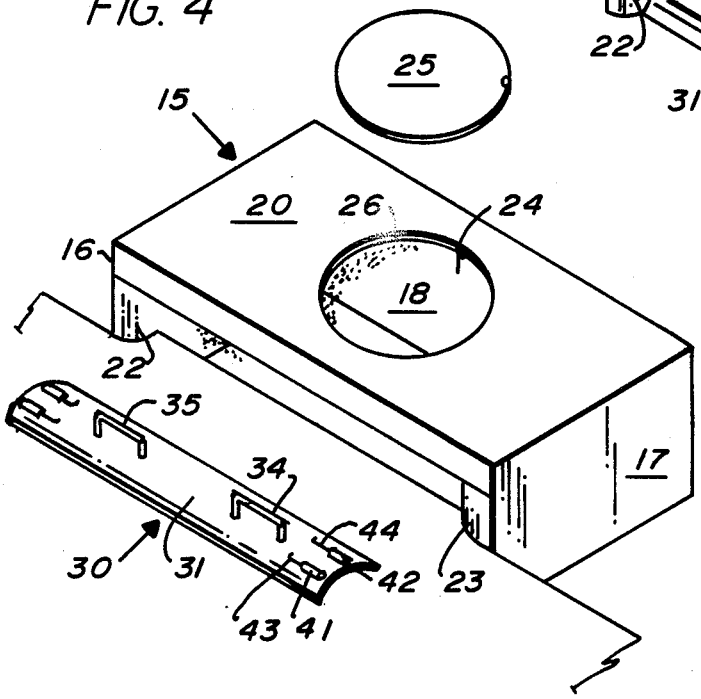
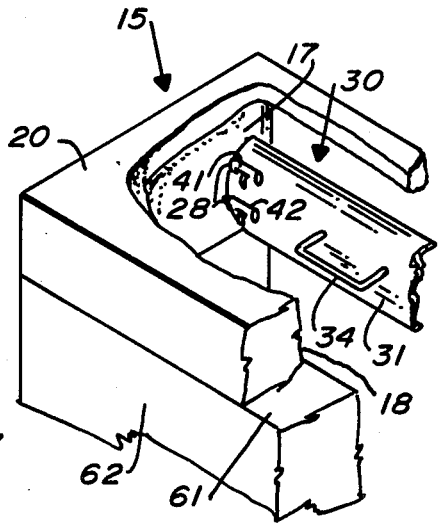
FIG. 3

CURB INLET WITH REMOVABLE GUTTER FORM

This invention relates to an improved curb inlet with a removable gutter form.

BACKGROUND OF THE INVENTION

Precast concrete curb inlets have been made for a long time. One shown in U.S. Pat. No. 4,192,625, included an integral form portion, which was described as preferably being made from fiberglass. A similar curb inlet, made entirely from reinforced concrete without a fiberglass form portion, had been on the market long before that patent issued.

In both of these curb inlets, a portion extending across the front and spaced down from the top-panel providing the inlet opening was permanently in place before installation and remaining there after installation, it was used as a form when the gutter was poured, and it could not be used again. Therefore, each time a curb inlet of that type was set in place and the gutter was poured the gutter form member remained with the curb inlet.

OBJECTS OF THE INVENTION

An object of the present invention is to provide an improved curb inlet in which the gutter form is removable after the concrete gutter has been poured and set. As a result, it can be used again repeatedly with other curb inlets.

Another object of the invention is to simplify the overall installation of drainage facilities and reduce the overall costs.

Other objects and advantages of the invention will appear from the following description of some preferred forms of the invention.

SUMMARY OF THE INVENTION

The invention provides an improved curb inlet with an integral casting which provides a rear wall, two side walls, and a top wall. This top wall may be provided with an opening to receive an access cover. The front is left open between its bottom and top. For the pouring operation, the opening is covered by a removable gutter form member bridging between the side walls. This removable form may be of a fiberglass-plastic or other reinforced plastic structure or may be of steel or other metal or any other suitable material. This form member defines the limit and shape of the gutter when that is poured.

This removable form is preferably provided with a pair of handles that help during placement, removal, and movement from one location to another. At each end of the form are locking bolts which fit into openings provided in the side walls of the curb inlet near the front face; the bolts are slidable in a sleeve, like a sliding latch for a door or gate. Thus, the form may be locked to the curb inlet by sliding the bolts into the bolt openings, and removed from the curb inlet by sliding the bolts out of the bolt openings, once the pouring has been done and the concrete has set. This removable form is preferably an arcuate or curved member that is generally rectangular in outline but with a curved wall.

BRIEF DESCRIPTION OF THE DRAWINGS

FIG. 1 is a view in perspective of a curb inlet embodying the principles of the invention, with the removable gutter form being shown in front before its installation.

FIG. 2 is a similar view with the gutter form member in place for pouring.

FIG. 3 is a fragmentary rear perspective view of a portion of the curb inlet with the removable gutter form in place, the top wall being broken away to show the form.

FIG. 4 is a view in perspective similar to FIGS. 1 and 2 with the gutter form removed after pouring and with the concrete access cover shown removed to provide the access to the interior of the curb inlet needed for removal of the gutter form.

DESCRIPTION OF A PREFERRED EMBODIMENT

Figure 6:
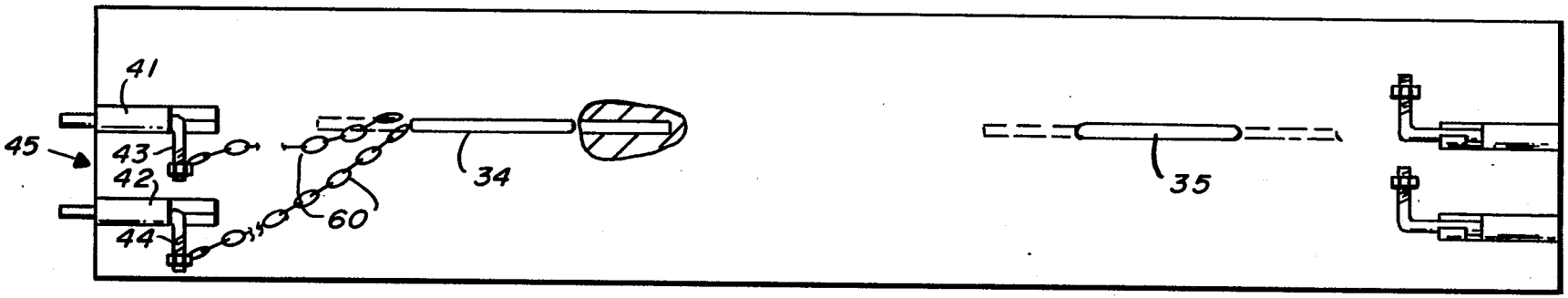
FIG. 6 is an enlarged view in rear elevation of the removable gutter form. On the left the locking bolts are shown in their closed position, as when they enter the opening in the curb inlet, and on the right the locking bolts are shown in their open position.
Figure 8:
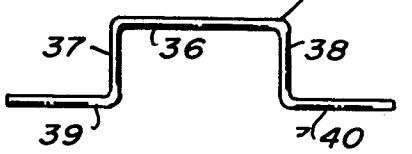
FIG. 8 is a view in elevation of one of the handles for the removable gutter form.

As shown in FIG. 1, a curb inlet 15 of the present invention has two vertical side walls 16 and 17, a rear wall 18 (See FIGS. 3 and 4), and a top wall 20. It may also have a short stiffening portion 21 extending across the bottom between the curved front faces 22 and 23 of the two side walls 16 and 17. The bottom is open, and in the top wall 20 is a central opening 24. The curb inlet 15, as so far described, is an integral casting of reinforced concrete. A separately cast concrete access cover 25 is designed to fit snugly in the opening 24, resting on a ledge 26, flush with the top surface of the top wall 20. The cover 25 may, if desired, be provided with a pick-receiving hole 27.

Cast into the interior surface of each side wall 16 and 17 of the curb inlet 15, near where the wall approaches its curved front face 22 or 23, are openings 28 to receive the locking bolts, described below. There may be two such openings 28 in each side wall 16, 17. The opening 28 may be made by drilling, if desired, instead of by casting, through casting is the normal procedure. Their location and alignment is important.

Figure 7:
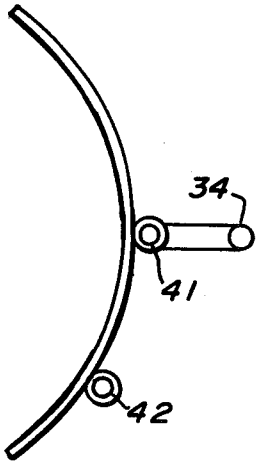
FIG. 7 is a view in end elevation of the removable gutter form of FIG. 6.

A removable gutter form 30 is an important part of this invention. It comprises an arcuate strip 31 which is generally rectangular, as seen in front or rear elevation (FIG. 6), though arcuate as seen in side elevation (FIG. 7). The front surface 32 is concave and the rear surface 33 convex. On the rear surface 33 of this member is affixed, as by an adhesive cement or (if metal such as steel) by welding, a pair of handles 34 and 35. In the drawing, they are shown as done by a process in which they are sunk into a structure incorporating a plastic, such as a fiberglass-resin structure and are curved over by more fiberglass-resin or other plastic-base reinforced structure strips. Each handle 34 or 35 has a central portion 36 which can be grasped by a hand, two support portions 37 and 38 that are perpendicular to the portion 36, and two base portions 39 and 40 which abut the rear surface 33 of the strip 31 and are cemented or welded or otherwise secured to it. When the strip 31 is made from a fiberglass-plastic structure, the embedment in and covering over by fiberglass-resin strips is preferred but cementing is possible; when it is metal, welding may be used.

Figure 9:
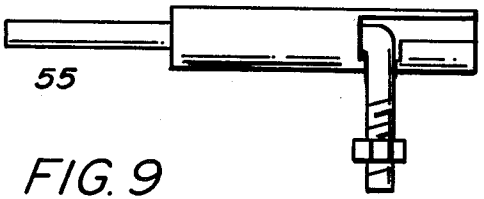
FIG. 9 is a further enlarged view in elevation of one of the locking bolts in its closed position.
Figure 10:
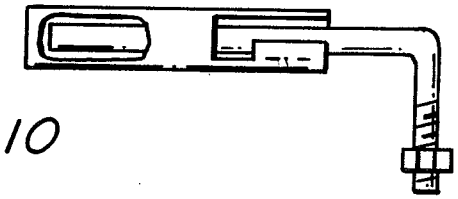
FIG. 10 is a similar enlarged view, with the locking bolt in its open position.

The removable gutter form 30 also has at each end a pair of sleeve members 41 and 42 which cooperate with a locking bolt 43 or 44. The sleeves may be adhered to the strip 31 by embedment in and covering over by the fiberglass-resin (or other suitable) material, or may be by a suitable cement or, when the form is metal, by welding or other suitable means. Each sleeve 41, 42 comprises a tube 45, and an open portion 46 having a latch slot 47 and a slide portion 48. Each locking bolt 43 or 44 may simply be an L-shaped member 50 with a cylindrical main portion 51 and a shorter portion 52 that is generally vertical. The main portion 51 has a locking end 53. The shorter portion 52 is preferably provided with threads 54 on which a nut 55 may be threaded or, if desired, the portion 52 may be left plain and a washer of suitable size and strength welded to it. When the locking bolt 43 or 44 is in its open position, as shown in FIG. 10 and at the right hand side of FIG. 6, the bolt 43 or 44 is slid so that the locking end 53 is well within the sleeve 41 or 42, whereas the shorter portion 52 lies entirely beyond the open portion 46 of the sleeve 41 or 42. The bolt 43 or 44 may be moved into closed position by rotating the bolt about 90° to raise the shorter portion 52, and then the bolt 43 or 44 may be slid into the tube 41 or 42 until the end portion 53 enters one of the openings in the curb inlet 15. Then the bolt 43 or 44 is rotated back so that the shorter portion 52 engages the locking slot 47; then the bolt 43 or 44 cannot be forced in either direction. This position is shown in FIG 9. For unlocking, the bolt 43 and 44 is again raised about 90° and then moved out, to the position of FIG. 10 as shown before.

Preferably, each locking bolt 43 or 44 is provided with a chain 60 which is anchored to the shorter portion 52 slightly above the nut 55 and is held there. The other end of the chain 60 is secured to a support portion 37 or 38 of the handle 34 or 35 before the handle is secured to the strip 31. It is better for the removable gutter form 30 to be in place, locked to the curb inlet 15 at the time when the member is installed.

Preferably, the upper bolt tube 45 is substantially in line with the handles 34 and 35, though that may not be necessary.

In installation, as shown in FIG. 3, a bottom edge 61 of the curb inlet 15 is placed on top of a standard drainage inlet box 62, with the gutter form 30 in place, its locking bolts 43 and 44 engaged in the cast holes 28 in the curb inlet 15. Then concrete may be poured up to the gutter flow line F, which is shown in broken lines in FIG. 2.

Figure 5:
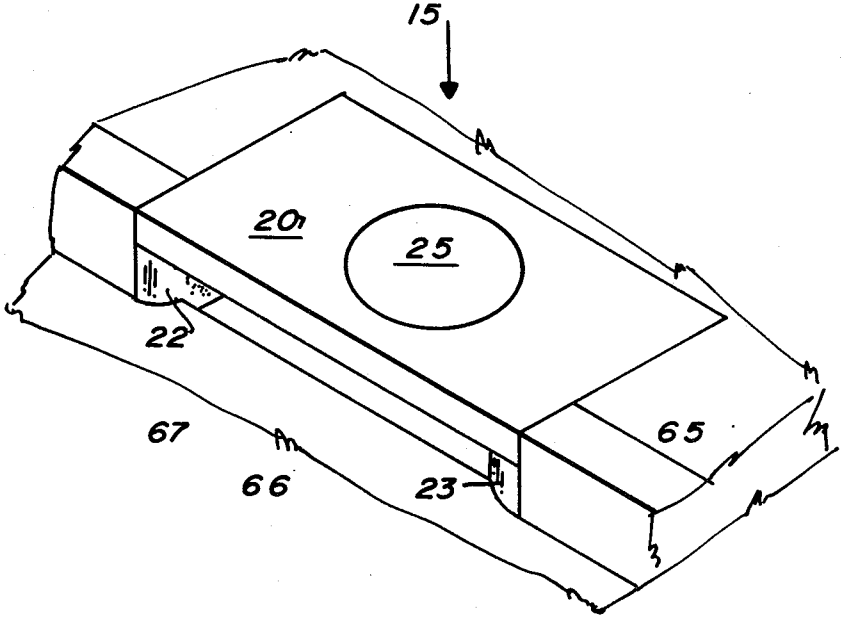
FIG. 5 is a similar view in perspective showing the finished gutter-curb combination with the curb inlet in place.

When the concrete has been poured and has set, the result is like that shown in FIG. 4. At that time the concrete access cover 25 can be removed with a pick ax or a lid lifter, and then a man either drops down inside the curb inlet 15 or may reach down with his arm and unlock the bolts 43 and 44. Usually it is done by getting inside, because of the size of the device, but it can be done by reaching down especially for a smaller size curb inlet 15. Once the locking bolts 43 and 44 are withdrawn from the openings 28, the form 30 is easily detached from the poured concrete and is extracted through the opening 24 of the curb inlet 15. When the form 30 is removed, the finished result looks somewhat as shown in FIG. 5 with the curb inlet 15 flush with the top of a curb 65 and with the gutter 66 properly located, so that it and the curb inlet 15 provides an opening 67 known as a drop inlet.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A curb inlet including in combination:

a concrete member having a rear wall, side walls, each said side wall having at least one bolt-receiving opening near its forward face, and a top wall with an access opening therethrough, a concrete access cover removably fitting in said access opening, and a removable non-concrete gutter form comprising an arcuate, generally rectangular strip having a concave front face and a convex rear face with a plurality of handles secured to said rear face and, also secured to that rear face, a plurality of aligning horizontal sleeves each having a tube portion and a latch portion and each having a locking bolt slidably mounted in said sleeves, said locking bolt being extendable beyond the edge of said form and retractable to within the area of said form, said bolts being spaced to conform to the spacing of the bolt-receiving openings in said side walls and used to secure the form in its pouring position, so that the form can be locked in place by the bolts entering said bolt-receiving openings, said form then retaining concrete when the concrete is poured, and after the concrete sets, by withdrawing the bolts from the bolt-receiving openings, the form can be removed from said concrete member taken out through said access opening for reuse in installation of another curb inlet.

2. The curb inlet of claim 1 wherein the form strip is a fiberglass-plastic resin structure.

3. The curb inlet of claim 2 wherein said handles and sleeves are secured by embodiment in the strip and covering over by more fiberglass-resin material.

4. The curb inlet of claim 2 wherein said handles and sleeves are secured to said rear face by a suitable cement.

5. The curb inlet of claim 1 wherein said form strip is a metal member.

6. The curb inlet of claim 5 wherein said handles and sleeves are welded to said rear face.

7. The curve inlet of claim 1 wherein there are two said bolt-receiving openings in each side wall and two sleeves at each end of said form strip.

8. A curb inlet including in combination:

a box-like reinforced concrete member having rear wall, side walls, each said side wall having a pair of cast recessed holes near its forward face, a top wall with an access opening therethrough, and a strengthening bottom-front member bridging said side walls at their front, the bottom otherwise being open, a concrete access cover removably fitting in said access opening, and a removable non-concrete, sheet-like gutter form comprising an arcuate, generally rectangular strip having a concave front face and a convex rear face with a pair of spaced-apart handles secured to said rear face and, also secured to that rear face, two pairs of aligning horizontal sleeves, one such pair at each end, each sleeve having a tube portion and a latch portion, and a locking bolt slidably mounted in each said sleeve, said locking bolts each being extendable beyond the edge of said form to engage in said cast recessed holes and retractable to within the area of the form, where they are withdrawn from said holes, said bolts being spaced to conform to the spacing of the cast holes to secure the form in its pouring position, so that the form can be locked in place with the bolts in said cast holes, said form then retaining concrete during pouring, and later, when the concrete has set, each bolt can be unlocked and the whole form removed from said concrete member, and taken out through said access opening for reuse in another curb inlet.

9. The curb inlet of claim 8 wherein said form strip is made of a fiberglass-resin structure and said handles and sleeves are secured thereto by embodiment in said structure and covering over by the same type of structure.

10. The curb inlet of claim 7 wherein said form strip is made of metal and the handle and sleeves welded to it.

11. A method of installing a curb inlet, a precast concrete member having a rear wall, side walls, each said side wall having a pair of recessed openings near its forward face, and a top wall with an access opening therethrough capable of receiving a removable concrete access cover, the steps of securing to said precast member a thin removable gutter form comprising an arcuate, generally rectangular strip with a concave front face and a convex rear face and with a pair of handles secured to said rear face and, also secured to that rear face, a pair of aligning horizontal sleeves with a tube portion and a latch portion and with locking bolts slidably mounted in said sleeves, said securing being done by extending said locking bolts beyond the edge of said form into said recessed openings, installing said precast member into position for pouring concrete around it, with the gutter form retained by said locking bolts extending into said retained openings, pouring concrete to provide curb and a gutter, said form helping to shape a portion of said gutter, after the poured concrete has set, retracting the bolts and sliding them to a position within the edge of the form, and then removing the form through said access opening for reuse in another curb inlet.

* * * * *